US006854933B2

(12) United States Patent
Horton, III

(10) Patent No.: US 6,854,933 B2
(45) Date of Patent: Feb. 15, 2005

(54) VERTICALLY RESTRAINED CENTERWELL SPAR

(75) Inventor: Edward E. Horton, III, Houston, TX (US)

(73) Assignee: Deepwater Technologies, Inc., Houston, TX (US)

( * ) Notice: Subject to any disclaimer, the term of this patent is extended or adjusted under 35 U.S.C. 154(b) by 0 days.

(21) Appl. No.: 10/213,967

(22) Filed: Aug. 7, 2002

(65) Prior Publication Data

US 2004/0028479 A1 Feb. 12, 2004

(51) Int. Cl.[7] ..... E21B 7/132

(52) U.S. Cl. ..... 405/224.2; 405/205; 405/223.1; 405/224; 114/264

(58) Field of Search ..... 405/195.1, 200, 405/201, 205, 223.1, 224, 224.2, 224.4, 227, 196; 114/264, 265; 166/350, 355

(56) References Cited

U.S. PATENT DOCUMENTS 4,217,848 A 8/1980 Meyer-Haake
4,606,673 A 8/1986 Daniell
4,702,321 A * 10/1987 Horton ..... 166/350
4,740,109 A * 4/1988 Horton ..... 405/224.2
4,895,481 A * 1/1990 Pepin-Lehalleur et al. .. 405/224
4,913,238 A 4/1990 Danazcko et al.
4,995,762 A 2/1991 Goldman
5,150,987 A 9/1992 White et al.
5,439,321 A 8/1995 Hunter
6,364,021 B1 * 4/2002 Coats ..... 166/350
6,488,447 B1 * 12/2002 Nish et al. ..... 405/224.2
2001/0036387 A1 * 11/2001 Richter et al. ..... 405/195.1

FOREIGN PATENT DOCUMENTS

WO WO 01/30646 A 5/2001

* cited by examiner

*Primary Examiner*—Sunil Singh
(74) *Attorney, Agent, or Firm*—Klein, O'Neill & Singh, LLP; Howard J. Klein

(57) ABSTRACT

In one example embodiment, a floating deep draft caisson vessel for drilling and production is provided. The vessel comprises an outer hull, wherein the outer hull has a hollow centerwell. The vessel further comprises a centerwell buoy guided within the centerwell. At least one tendon assembly secures the centerwell buoy to the sea floor and the tendon assembly is attached along essentially the centerline of the centerwell buoy.

10 Claims, 4 Drawing Sheets

VERTICALLY RESTRAINED CENTERWELL SPAR

BACKGROUND OF THE INVENTION

The present invention relates generally to floating offshore production vessels. Goldman (U.S. Pat. No. 4,995,762); Hunter (U.S. Pat. No. 5,439,321); Danzacko (U.S. Pat. No. 4,913,238); Meyer-Haake (U.S. Pat. No. 4,217,848); Horton (U.S. Pat. No. 4,702,321), (U.S. Pat. No. 4,740,109) disclose offshore floating vessels of various configurations, all incorporated herein by reference. In these and other conventional vessels, risers running from the well head to the drilling or production equipment are supported by a buoyancy apparatus which either directly supports the risers with a floating vessel, or indirectly supports the risers with individual buoyancy cans, or some other means such as hydraulic cylinders attached between the vessel and the risers.

Offshore environmental conditions are often harsh. Because the buoyancy apparatus is supporting the risers, these risers are directly subjected to the wave action on the buoyancy apparatus. This puts strain on the risers.

Furthermore, wave action attenuates with depth. Therefore, there is less wave action at 500 feet than there is at the surface. Thus, the riser at the sea floor experiences virtually no wave and current action, while the same riser at the surface of the water experiences very harsh wave and current action. Even further, the buoyancy apparatus itself, experiences different wave and current action at the top of the buoyancy apparatus than at the bottom of the buoyancy apparatus.

Even further, many conventional buoyancy apparatuses have short natural periods. For example, conventional tension leg platforms, have a natural period in the three to four second range. Such a short natural period can cause resonance problems such as springing and ringing.

Therefore, there is a long felt need for a buoyancy apparatus that protects the risers from wave action at the surface, is designed to compensate for varying wave action with depth, and has a longer natural period.

SUMMARY OF THE INVENTION

The present invention addresses the problems just described. In one example embodiment, a floating deep draft caisson vessel for drilling and production is provided. The vessel comprises an outer hull, wherein the outer hull has a hollow centerwell. The vessel further comprises a centerwell buoy guided within the centerwell. At least two concentric tendons secure the centerwell buoy to the sea floor and are attached essentially along the centerline of the centerwell buoy.

DETAILED DESCRIPTION OF EXAMPLE EMBODIMENTS OF THE PRESENT INVENTION

Figure 1:
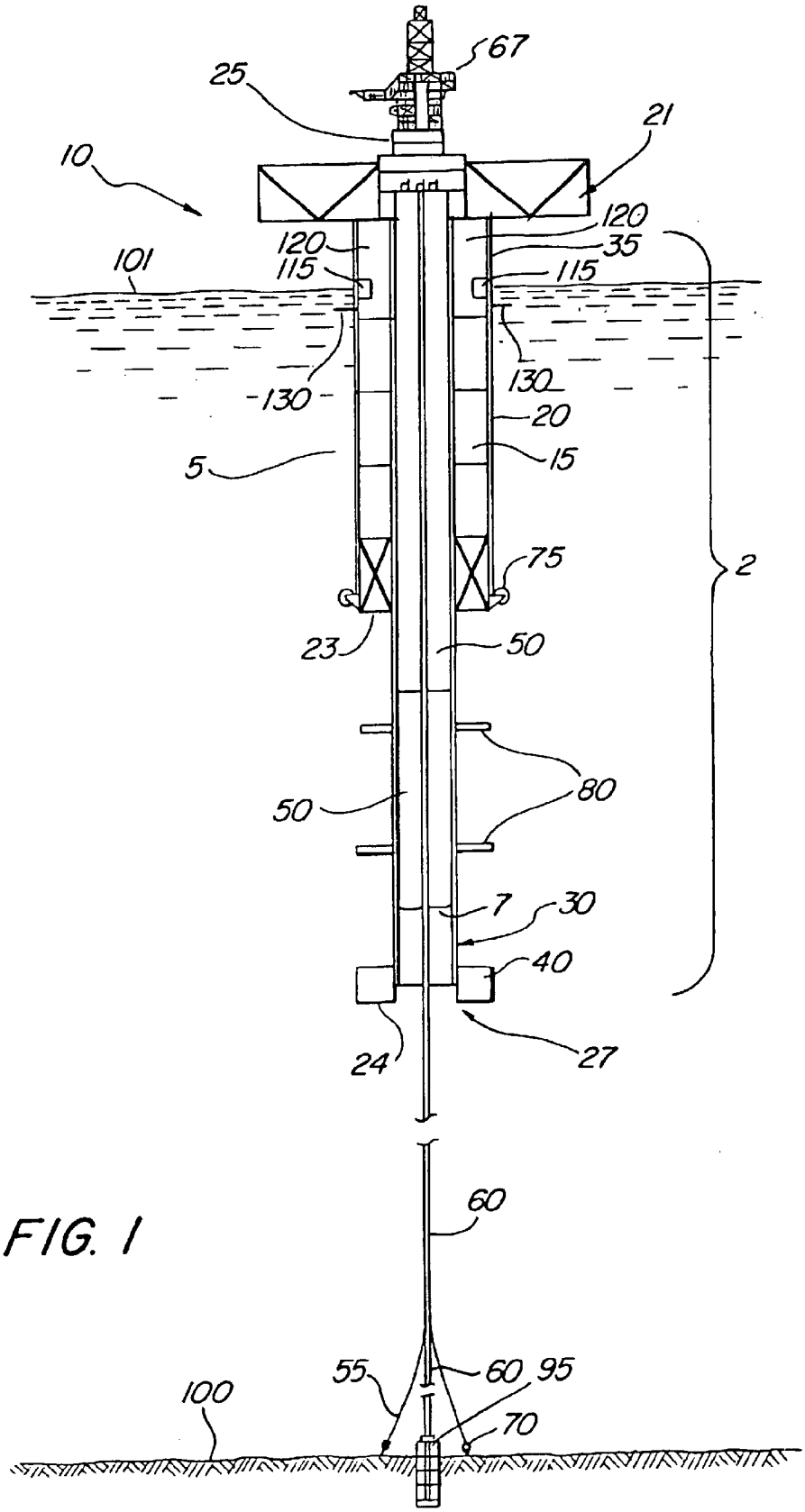
FIG. 1 shows a cross-sectional view of one example embodiment of a vessel where the risers are coupled to the central tendon assembly and the drilling equipment is supported by the centerwell buoy.
Figure 2:
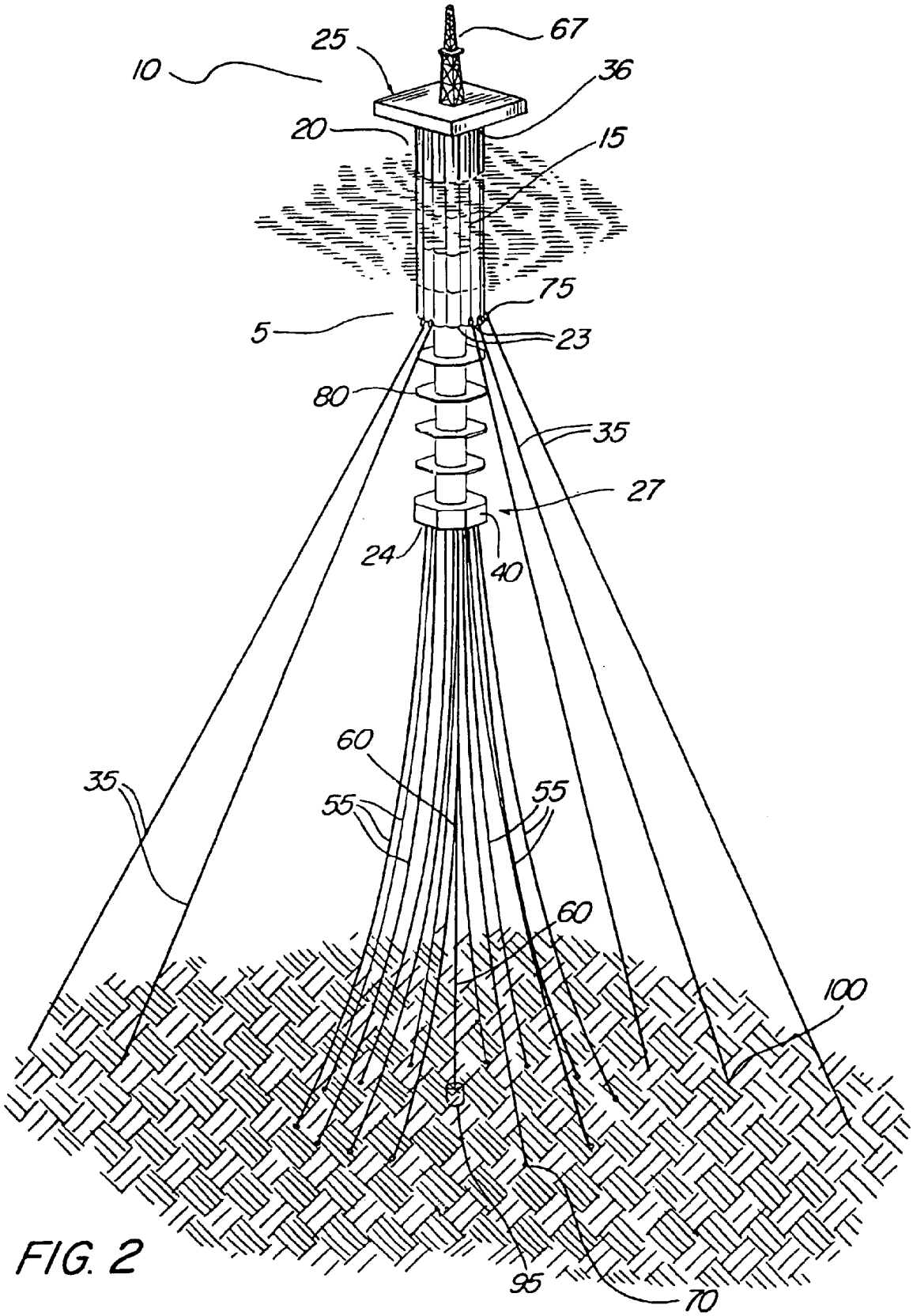
FIG. 2 is an angular view of an example embodiment of the vessel.
Figure 3:
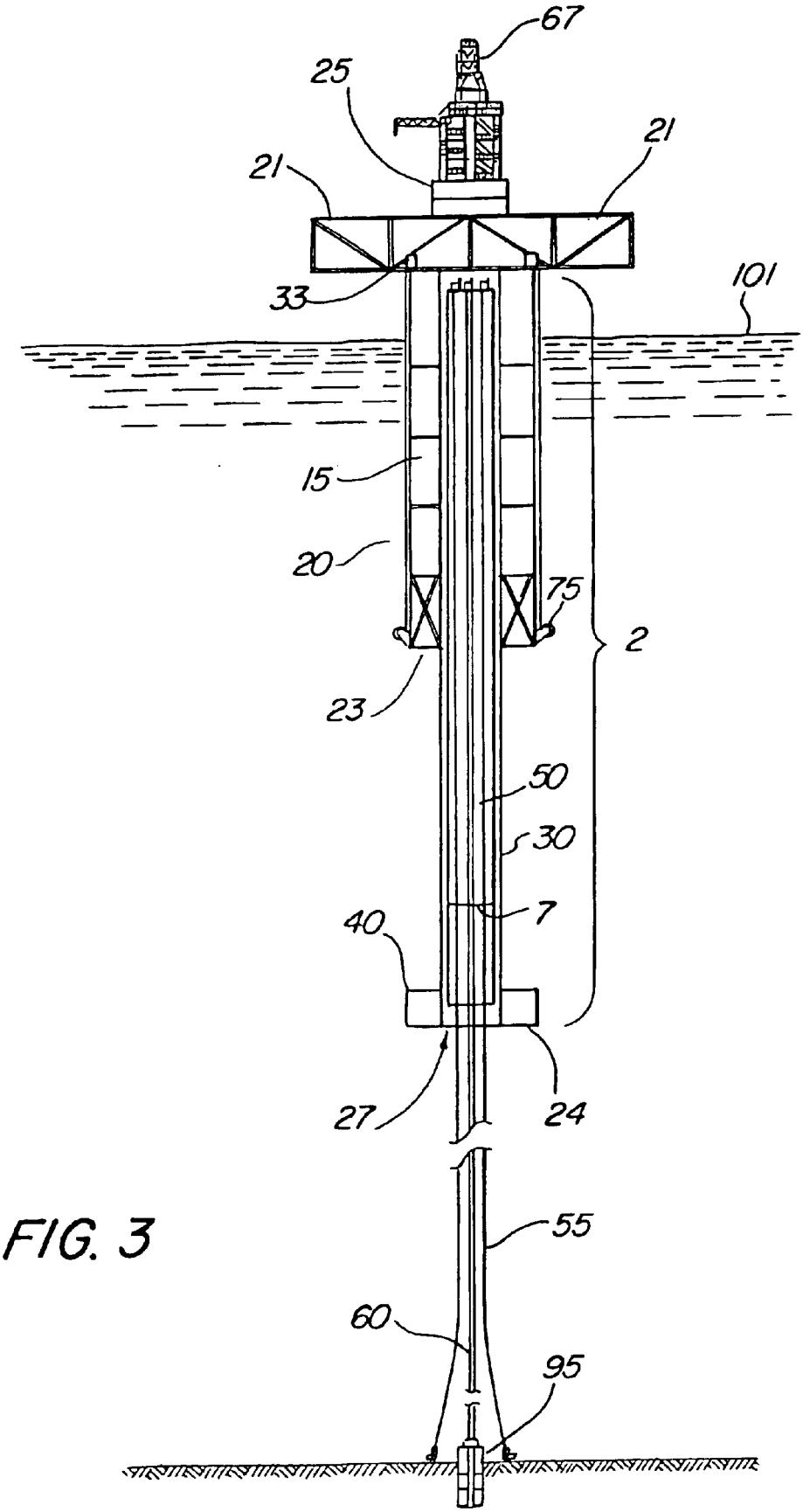
FIG. 3 shows another sectional view of an example embodiment of the vessel where the risers are not coupled to the central tendon assembly and the drilling equipment is supported by the outer hull.
Figure 4:
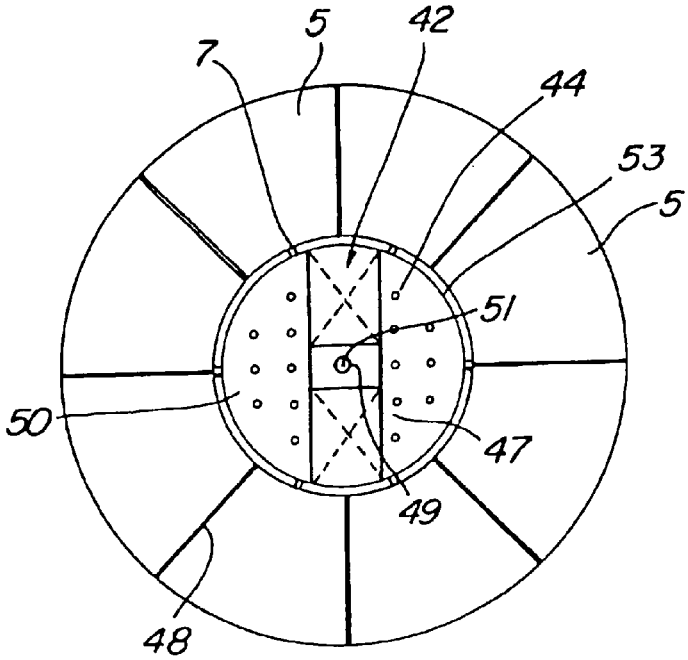
FIG. 4 shows a cross-sectional view of an upper hull and centerwell buoy of one example embodiment of the vessel.

FIGS. 1, 2, and 3 illustrate example embodiments of the vessel of the present invention from a cross-sectional view from the side (FIGS. 1 and 3) and an angular view (FIG. 2). FIG. 1 shows a vertically restrained centerwell vessel 2 in use in its offshore environment. The vertically restrained centerwell vessel 2 comprises an outer hull 5 having a hollow centerwell 7 and a centerwell buoy 50 guided within the centerwell 7, so as to define a space 53 between the centerwell buoy and the hull 5, as shown in FIG. 4. A tendon assembly 60 having at least two concentric tubulars 52 (FIG. 5A) secures the centerwell buoy to the sea floor 100, and is attached along essentially the axial centerline 51 (FIG. 4) of the centerwell buoy 50. The centerwell buoy 50 supports at least one riser 55, which is attached to a well head 70 at the sea floor 100 and is attached at the deck 25 of the vessel at the surface 101 of the water.

The centerwell buoy 50 is "guided" by the outer hull 5. That is, the outer diameter of the centerwell buoy 50 is constrained by the inner diameter of the centerwell 7 of the outer hull 5. Although the outer hull 5 constrains the centerwell buoy 50, the centerwell buoy 50 is itself free floating. Because the outer hull 5 and the centerwell buoy 50 are each free-floating, the outer hull 5 moves to accommodate the environmental forces acting on it and thus, moves with respect to the vertically restrained centerwell buoy 50. Thus, the outer hull's 5 movement is decoupled from the centerwell buoy 50. This isolates the risers 55 that are supported by the centerwell buoy 50 from the wave and current action absorbed by the outer hull 5. Furthermore, in some embodiments, several guides (not illustrated) are between the outer hull 5 and the centerwell buoy 50. These guides (not illustrated) maintain the centerwell buoy 50 within the outer hull 5. Thus, the centerwell buoy 50 is constrained in the vertical and rotational directions. By constraining the centerwell buoy 50 in the rotational direction, there is less stress on the risers and tendon assembly due to less motion on the buoy 50.

In some embodiments, the centerwell buoy 50 and the outer hull 5 are in actual contact, while in others, a pad (not illustrated) is compressed between the centerwell buoy 50 and the outer hull 5. The pad further reduces wave and current action transferred to the centerwell buoy 50 from the outer hull 5.

Turning now to the outer hull 5, the outer hull 5 comprises an upper hull 20 and a lower hull 30. The upper hull 20 and the lower hull 30 share a continuous hollow centerwell 7 of the outer hull 5, which surrounds and guides the centerwell buoy 50. The upper hull 20 has a greater outer diameter than the lower hull 30. The change in diameter between the upper hull 20 and the lower hull 30 causes the entire outer hull 5 to have a "step" 23 in appearance where the upper hull 20 and the lower hull 30 meet.

As stated briefly above, wave amplitude attenuates with depth. For example, there is less wave action at 225 feet than at the surface 101, and at 500 feet the water is virtually still. In one embodiment, the step 23 between the upper hull 20 and lower hull 30 is at a depth of 225 feet or more. A second step 24 having about the same area as the first stepped area is at the keel 27, which is at a depth of 500 ft. This second step 24 provides offsetting inertial and drag forces to offset the forces on the first step 23, thereby limiting heave amplification of the vessel 10.

This double stepped configuration 23, 24 of the outer hull 5 also results in a longer natural period for the vessel 10 when the tendon assembly 60 is connected to the sea floor 100. In the double stepped embodiments illustrated in FIGS. 1–3, the natural period is in the 10–12 second range when the tendon assembly 60 is connected to the seafloor 100. As discussed briefly above, conventional tension leg platforms, for example, have resonant problems in the 3–4 second range. This causes resonant problems such as so-called "springing" and "ringing." Thus, the double-stepped embodiments illustrated in FIGS. 1–3 have fewer resonance problems.

In the illustrated embodiment of FIG. 1, the upper hull 20 comprises a variable ballast system 15. In one embodiment, the variable ballast system 15 varies the natural period of the vessel 10. To do so, the outer hull 5 has openings 115 at or near the water plane area 101 in selected cylindrical and/or interstitial compartments 120. By allowing sea water to flow in and out as the water level changes relative to the vessel 10, the natural period is varied. This ballasts the vessel 10. Furthermore, decks 130 are provided below the openings. By varying the water plane area, the vessel 10 is also more easily controlled under tow. In further embodiments, the outer hull 5 comprises conventional variable ballast, or any other variable ballast that will occur to those of ordinary skill in the art.

Turning now to the lower hull 30, as illustrated in FIG. 2, the lower hull 30 comprises a long tubular shaped hull with fixed ballast 40 near the bottom of the lower hull 30. The fixed ballast 40 at the bottom of the lower hull 30 lowers the center of gravity of the vertically restrained centerwell vessel 2 and improves the stability of the entire vessel 10. Furthermore, the fixed ballast 40 at the bottom of the lower hull 20 has sufficient weight to keep the vessel vertical when under tow. Thus, the vessel 10 is towable without removing the deck 25. To tow the vessel 10, the tendon assembly 60 is simply removed and the vessel 10 is towed to its new location.

The embodiments of FIGS. 1, 2 and 3 will now be contrasted slightly. One distinction between the embodiments is that in the embodiment of FIG. 1, the deck 25 is supported by the centerwell buoy 50, while in the embodiments of FIGS. 2 and 3 the deck 25 is supported by the outer hull 5.

In the embodiment of FIG. 1, the outer hull 5 supports the quarters and utilities 21 for the vessel 10. The centerwell buoy 50 supports a deck 25. In various embodiments, the deck 25 is a conventional deck such as a deck used on floating structures such as SPARS, TLP's, decks that support drilling, work over or production equipment, or any other deck 25 that will occur to those of ordinary skill in the art. Supporting the deck 25 with the centerwell buoy 50 has benefits and drawbacks. The benefit is that the centerwell buoy 50 is vertically restrained by the tendon assembly 60 and protected from wave action from the outer hull 5. Thus, the deck 25, the drilling equipment 67, and risers 55 are protected from wave action by the outer hull 5. As a result, drilling operations will be less weather dependant in this configuration. The drawback is that the centerwell buoy 50 will require additional buoyancy to support the extra weight of the drilling equipment 67.

In the embodiment of FIGS. 2 and 3, the deck 25, the quarters and utilities 21 are supported by the outer hull 5. In this embodiment, the deck 25 and the drilling equipment 67 are subjected to the wave action on the outer hull 5, but the riser 55 system is still supported by the centerwell buoy 50, which is protected by this wave action from the outer hull 5.

Turning now to constraining the outer hull 5, FIG. 2 illustrates lateral mooring lines 35, which secure the outer hull 5. The later mooring lines 35 are secured to the top of the upper hull 20 portion of the outer hull 5 and run down the outside of the upper hull 20 portion of the outer hull 5. The mooring lines 35 then run through fairleads 75, which are located at the bottom of the upper hull portion 20 of the outer hull 5. Views of the placement of the fairleads 75 are illustrated in FIGS. 2 and 3. These fairleads 75 constrain the mooring lies 35 to the bottom of the upper hull portion 20 of the outer hull 5. As shown in FIG. 2, the lateral mooring lines 35 are then spread out and attached to the sea floor 100. The mooring lines 35 are attached to the sea floor 100 in conventional manners that will occur to those of ordinary skill in the art without further explanation. The lateral mooring lines 35 are designed to limit the horizontal movement of the vessel relative to the sea floor wellheads 70 to specified limits to prevent the risers 55 from being over stressed. In one example embodiment, the design limits are about 5% offset of the water depth.

By positioning the fairleads 75 at the bottom of the upper hull 30, outer hull's 5 pitch and roll are restrained. The mooring lines 35 counteract wind and current acting on the outer hull 5 and therefore, the vessel 10. The horizontal component of the tendon assembly 60 further counteracts wind and current for the centerwell buoy 50. In alternate embodiments, a catenary mooring system, a taut leg mooring system, or any other system that will occur to those of ordinary skill in the art restrains the outer hull 5.

In the embodiment illustrated in FIGS. 1 and 2, the vessel has heave plates 80. The illustrated heave plate 80, is a flat surface extending outwardly from the lower hull 30. These heave plates 80 reduce heave by allowing water above and below each heave plate 80. Thus, to move up or down, the vertically restrained centerwell vessel 2 must move the water either above the heave plate 80 or below the heave plate 80. Therefore, the water itself reduces the heave of the vessel 10. In alternate embodiments, as illustrated in FIG. 3, the vessel has no heave plates 80.

Turning now to the vertical motion of the centerwell buoy 50, as illustrated in FIGS. 1–3 a tendon assembly 60 and the riser system 55 are secured to the sea floor 100 at one end and to the floating centerwell buoy 50 at the other end. The risers 55 and the tendon assembly 60 are secured to, and pass through the centerwell buoy 50, and are accessible at the deck 25.

Turning now to FIG. 4, in a horizontal cross-sectional view of an example embodiment of the centerwell buoy 50 and the outer hull 5, the centerwell buoy 50 has a tendon slot 49 on the vertical centerline 51 of the centerwell buoy 50 that provides a passage for the tendon assembly 60 from the well deck 25 through the keel 27 and down to a caisson pile or anchor assembly 95 (described below). Around the tendon assembly 60 and the tendon slot 49 are riser slots 44. Risers 55 pass through the riser slots 44 up to the deck 25 and down to the sea floor 100 where the riser 55 is secured to the well head 70. In a further embodiment, there is a space 47 between the tendon slot 49 and the riser slots 44 for running equipment down to the seafloor 100 (for example, landing bases, blowout preventors, or any other equipment that will occur to those of ordinary skill in the art).

In the illustrated embodiment, on either side of the central tendon assembly 60 and the central tendon slot 49 is a drilling well or moon pool 42. In FIG. 4, two moon pools 42 are shown. The moon pool 42 also provides space for running equipment down to the seabed 100.

The illustrated embodiment further comprises bulkheads 48 in the outer hull 5. In various embodiments, the bulkheads 48 divide the outer hull 5 into various compartments, which are used, in alternate embodiments, for fixed ballast, variable ballast, storage, buoyancy or any other use that will occur to those of ordinary skill in the art.

In the drawing figures, only one tendon assembly 60 is shown. However, in further embodiments, more than one tendon assembly 60 restrains the centerwell buoy 50. In these further embodiments, there is at least one tendon assembly 60 on the vertical centerline 51 of the vertically restrained centerwell buoy 50. The various other multiple tendon assemblies (not illustrated) are arranged around the central tendon assembly.

Figure 5A:
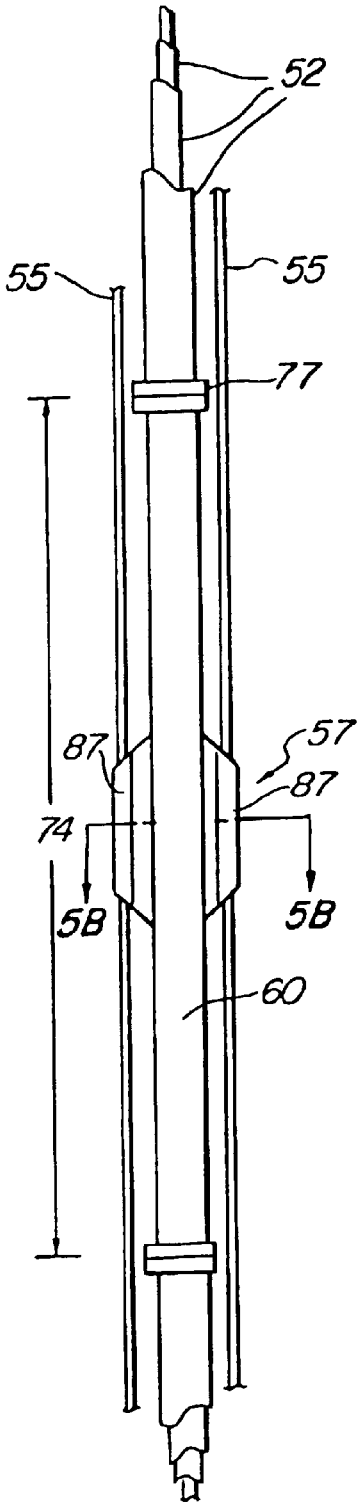
FIG. 5*a* shows a side view of a tendon assembly and a riser guide.
Figure 5B:
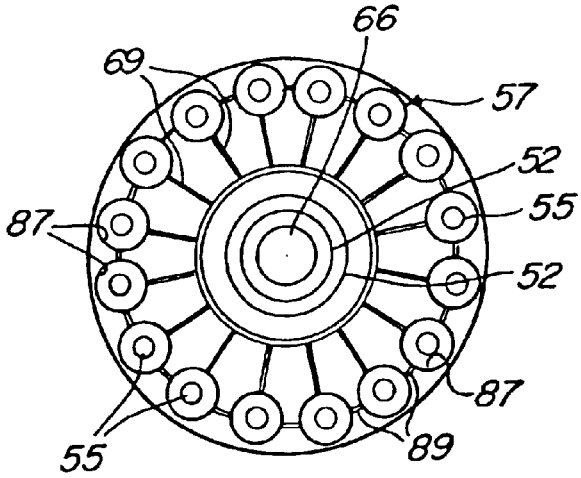
FIG. 5*b* shows a cross-sectional view of a riser guide.

Turning now to the tendon assembly 60 itself, FIGS. 5A and 5B show a detailed picture of one example embodiment of a tendon assembly 60. In one embodiment, the tendon assembly 60 comprises multiple concentric tubulars 52. These multiple concentric tubulars 52 are secured at the well deck 25 (FIG. 1) on the vertical centerline 51 of the centerwell buoy 50 and pass down through the tendon slot 49 of the centerwell buoy 50 and are connected to the anchor assembly 95 at the sea floor 100. The anchor assembly 95 will be discussed in detail below.

Multiple concentric tubulars 52 provide strength to the tendon assembly 60. The multiple concentric tubulars 52 also provide a spring characteristic to the vessel 2. By varying the number of concentric tubulars 52, both strength and elasticity are varied to meet specific design requirements on a case-by-case basis as will occur to those of ordinary skill without further explanation.

In the illustrated embodiment, the tendon tubulars 52 further comprise conventional oilfield casing joints 77, each comprising a flanged coupling. In various embodiments, the casing joints 77 are various sizes depending on the required tensile loads. These loads vary on a case-by-case basis as will occur to those of ordinary skill in the art.

In one embodiment, the tendon assembly 60 is installed section 74 by section 74 using the drilling rig 67 on the vessel 25. Each section 74 is installed on the deck 25 and lowered using the rig 67, and the sections 74 are connected using the casing joints 77. Installing the tendon assembly 60 in pieces using the vessel's 10 own drilling rig 67 is clearly an advantage. There are other benefits as well. For example, in further embodiments, corrosion and fatigue are minimized by the use of corrosion inhibitors (not illustrated ) between the tubulars 52. Still another benefit is that the multiple concentric tubulars 52 are easily disconnected if the vessel 10 is moved to a new site. Another benefit is that multiple tubulars 52 provide redundancy should one of the tubulars 52 fail. Another benefit is that the annuli of the tubulars are, in some embodiments, pressurized to detect cracks and joint integrity. For example, a loss of pressure could indicated structural problems.

In one embodiment, the tendon assembly 60 weighs between 500 lbs./ft. to 1,000 lbs./ft. Thus, the total weight of the tendon assembly 60 in 5,000 feet of water is on the order of 2,500 kips to 5,000 kips.

FIG. 5B shows a cross-section of a riser guide 57, which is also shown from the side in FIG. 5A. The riser guide 57 couples the tendon assembly 60 to the risers 55. As shown from the side in FIG. 5A, the riser guide 57 separates the risers 55 from one another and the central tendon assembly 60. The riser guide 57 helps prevent the risers 55 and tendon assembly 60 from clashing with one another. Returning to the cross-sectional view in FIG. 5B, in the illustrated embodiment, the riser guide 57 comprises a central tendon channel 66 for the central tendon assembly 60 to pass through the guide 57. The riser guide also comprises a plurality of riser channels 87 for the risers 55 to pass through the guide 57 circumferentially around the tendon slot 66. The riser guide 57 is secured to the central tendon assembly 60. In alternate embodiments, the riser guide 57 is or is not secured to the risers 55. The central tendon channel 66 and the riser channels 87 are rigidly connected and separated by radial separators 69. By rigidly separating the riser channels 87 and the central tendon slot channel 66, the risers 55 passing through the riser channels 87 are separated from the central tendon assembly 60 passing through the tendon channel 66. This prevents the risers 55 and the tendon assembly 60 from clashing below the keel 27 of the vessel 10 due to vortex induced vibrations which can occur when subjected to light ocean currents. The riser channels 87 may be connected to each other by connecting members 89, as shown in FIG. 5B, for additional strength and rigidity. In one embodiment, the separators 69 are approximately 5 meters. In other embodiments, (for example, the embodiment of FIG. 3) the risers 55 are not coupled to the tendon assembly 60.

Returning to the examples seen in FIGS. 1 and 2, in one embodiment, the tendon assembly 60 is secured to the seabed 100 by the caisson pile 95, which is alternatively called an anchor caisson or a suction pile as will occur to those of ordinary skill in the art. The caisson pile 95 secures the tendon assembly 60 to the sea floor 100. In still a further embodiment, the tendon assembly 60 is connected to the caisson pile 95 by a tendon connective sleeve (not illustrated). The tendon connective sleeve (not illustrated) connects the tendon assembly 60 to the caisson pile 95.

The tendon connection sleeve (not illustrated) is located in the center of the caisson pile 95 through which the bottom end of the tendon assembly 60 is attached to the seafloor 100. Radial vertical plates (not illustrated) connect the tendon assembly 60 to the wall of the caisson pile 95 to the tendon sleeve (not illustrated). To install the caisson pile 95, in one embodiment, the caisson pile 95 is pushed into the sea floor by pumping water from within the caisson pile 95. By removing the sea water from within the caisson, the surrounding pressure pushes the caisson pile 95 into the sea floor 95. In alternate embodiments, the caisson 95 is pushed into the sea floor with submersible pumps, airlifts, or any other method that will occur to those of ordinary skill in the art. With the caisson pile 95 firmly anchored to the sea floor 100, the tendon connective sleeve (not illustrated) connects the tendon assembly 60 to the caisson pile 95, thereby securing the tendon assembly 60 to the sea floor 100.

In still a further embodiment, at least one of the tubular members 52 of the tendon assembly 60 is drilled into the sea floor 100 and cemented into the sea floor 100. This increases the pull-out capacity of the tendon assembly 60. The tendon connection sleeve (not illustrated) is extended out of the bottom of the caisson pile 95, which then provides a connector (not illustrated) through which the tendon tubulars 52 are drilled and connected.

The tendon assembly 60 is secured to the seafloor 100 by any method that will occur to those of ordinary skill in the art.

FIGS. 1–5 illustrate the upper hull 20, and lower hull 30 as a cellular, or tubular-shaped hull. In alternate embodiments, the shape of the upper hull 20, or lower hull 30 is tubular, circular, octagonal, triangular, or any other shape that will occur to those of ordinary skill in the art.

Turning now to general considerations, in alternate embodiments of the present invention, a wide range of riser 55 types are used to connect the well head 70 to the vessel 25. The various risers 55 include those used for drilling, production, and work over as will occur to those of ordinary skill in the art without further explanation. For example, in alternate embodiments, the risers 55 are drilling risers used with full sub-sea blow-out preventor (BOP) stacks, pressure risers used with surface BOP's, and those used with split BOP's (e.g. surface BOP for well control and limited function BOP on the sea floor for safety). In still further embodiments, production risers 55 and workover risers used with surface trees, sub sea trees, split trees, wet trees, dry trees, or any other tree that will occur to those of ordinary skill in the art. In still a further embodiment, the vessel is designed for vertical entry into the wells 70. In even further embodiments (not illustrated) the vessel is designed for any other directional entry into the well 70.

While the risers 55 have a wide range of classification and designs, each of these alternate embodiments has traits in common. A plurality of risers 55 will together act with a spring characteristic and strength characteristics for the group of risers 55. Said differently, the risers 55 act as a system and their structural and elastic properties achieve a uniform behavior for the group of risers 55. Thus, the spring like characteristic of a group of risers 55 absorb the wave action subjected to the by the centerwell buoy 50.

The most common application of aspects of this invention is in deepwater offshore oil production and drilling, wherein the risers are not tensioned by equipment on the hull, but by a separate floating body. In various other embodiments, the invention is used in shallow water, or any other environment that will occur to those of ordinary skill in the art.

The above described example embodiments of the present invention are intended as teaching examples only. These example embodiments are in no way intended to be exhaustive of the scope of the present invention.

I claim:

1. A deep draft, vertically-restrained floating vessel that is securable to the sea floor, comprising:

an outer hull having a hollow centerwell;

a centerwell buoy disposed within the centerwell, and having an axial centerline;

a tendon assembly attached to the centerwell buoy along the centerline thereof and securing the centerwell buoy to the sea floor;

a plurality of risers passing through the centerwell buoy and extending to the sea floor; and a riser guide, within the centerwell buoy, coupling the risers to the tendon assembly in a spared-apart relationship.

2. The vessel of claim 1, wherein the tendon assembly comprises at least two concentric tubular tendon elements.

3. The vessel of claim 1, wherein the riser guide comprises:

a central tendon channel; and a plurality of riser channels arranged circumferentially around the tendon channel.

4. The vessel of claim 3, wherein each of the riser channels is connected to the tendon channel by a radial separator element.

5. The vessel of claim 3, wherein the riser channels are connected to each other.

6. The vessel of claim 1, wherein the centerwell buoy has at least one riser slot and at least one tendon slot.

7. A deep draft, vertically-restrained floating vessel that is securable to the sea floor, comprising:

an outer hull having a hollow centerwell;

a centerwell buoy disposed within the centerwell, and having an axial centerline;

a tendon assembly attached to the centerwell buoy along the centerline thereof and securing the centerwell buoy to the sea floor;

a plurality of risers passing through the centerwell buoy and extending to the sea floor; and a riser guide, within the centerwell buoy, coupling the risers to the tendon assembly in a spaced-apart relationship, the riser guide comprising:

a central tendon channel;

a plurality of riser channels arranged circumferentially around the tendon channel; and a radial separator element connecting each of the riser channels to the tendon channel.

8. The vessel of claim 7, wherein the tendon assembly comprises at least two concentric tubular tendon elements.

9. The vessel of claim 7, wherein the riser channels are connected to each other.

10. The vessel of claim 7, wherein the centerwell buoy has at least one riser slot and at least one tendon slot.

* * * * *